US005651276A

United States Patent [19]

Purer et al.

[11] Patent Number: 5,651,276

[45] Date of Patent: Jul. 29, 1997

[54] DRY-CLEANING OF GARMENTS USING GAS-JET AGITATION

[75] Inventors: Edna M. Purer; Angela Y. Wilkerson; Carl W. Townsend, all of Los Angeles; Sidney C. Chao, Manhattan Beach, all of Calif.

[73] Assignee: Hughes Aircraft Company, Los Angeles, Calif.

[21] Appl. No.: 592,274

[22] Filed: Jan. 26, 1996

Related U.S. Application Data

[62] Division of Ser. No. 335,601, Nov. 8, 1994.

[51] Int. Cl.[6] ..... D06B 1/02

[52] U.S. Cl. ..... 68/5 C; 68/207; 68/183

[58] Field of Search ..... 68/207, 183, 355, 68/56; 134/102.2, 184

[56] References Cited

U.S. PATENT DOCUMENTS

| | | | |
|---|---|---|---|
| 1,616,132 | 2/1927 | La Fountain . | |
| 1,714,223 | 5/1929 | Hondeville et al. . | |
| 2,029,117 | 1/1936 | Otis . | |
| 2,431,246 | 11/1947 | Hallanan | 68/183 |
| 2,575,039 | 11/1951 | Barnes | 68/183 |
| 2,729,844 | 1/1956 | Weiss . | |
| 3,293,890 | 12/1966 | Valdespino | 68/183 |
| 3,447,174 | 6/1969 | Candor et al. | 68/183 |
| 3,504,510 | 4/1970 | Freze et al. . | |
| 3,600,731 | 8/1971 | Bergholtz | 68/183 |
| 3,722,235 | 3/1973 | McGee, Jr. | 68/183 |
| 4,941,333 | 7/1990 | Blessing | 68/207 |
| 5,161,394 | 11/1992 | Felzer et al. | 68/207 |
| 5,267,455 | 12/1993 | Dewees et al. . | |
| 5,307,649 | 5/1994 | Lim et al. | 68/183 |
| 5,467,492 | 11/1995 | Chao et al. | 68/207 |

FOREIGN PATENT DOCUMENTS

| | | |
|---|---|---|
| 1313500 | 1/1962 | France . |
| 1290998 | 9/1962 | France . |
| 2036592 | 3/1970 | France . |
| 3904514 | 8/1990 | Germany . |

*Primary Examiner*—Frankie L. Stinson

*Attorney, Agent, or Firm*—M. E. Lachman; M. W. Sales; W. K. Denson-Low

[57] ABSTRACT

Substantial amounts of particulate soils in garments can be removed by agitation in gas-jet in a solvent-free, low-pressure environment. The ability of the present gas-jet agitation system to remove particulate soils from garments and fabrics rivals that of conventional dry-cleaning processes which agitate the garments and fabrics while immersed in solvent. Thus, a dry-cleaning operation may consist of a solvent-immersion step for removing soluble soils and a gas-jet agitation step to remove particulates. Considerable savings in equipment and operating costs may be realized in the practice of the invention, since solvent flow rates need not be boosted to provide necessary agitation for particulate soil removal. The savings achievable by employing gas-jet agitation are even more pronounced in dense phase gas dry cleaning systems, which require pressurized environments to maintain a liquified solvent. Advantageously, the apparatus employed in the practice of the invention has no moving parts and is relatively inexpensive to fabricate and maintain. Further, the gas used as a means of agitation may be any commonly-available inexpensive gas, such as carbon dioxide, nitrogen, or air, so that the process is environmentally-friendly.

9 Claims, 3 Drawing Sheets

DRY-CLEANING OF GARMENTS USING GAS-JET AGITATION

This application is a division of Ser. No. 08/335,601 filed Nov. 8, 1994.

CROSS-REFERENCE TO RELATED APPLICATION

The present application is related to U.S. Pat. No. 5,467,492, which discloses and claims an apparatus in which liquid carbon dioxide is employed to clean soiled garments and fabric materials by removing soiling substances therefrom, and further discloses and claims the process by which the apparatus is operated. The present application is directed to providing a relatively low-pressure means of agitating the garments and fabric materials in a dry-cleaning process, regardless of whether liquid carbon dioxide-or conventional dry-cleaning solvents such as perchloroethylene are employed.

BACKGROUND OF THE INVENTION

1. Field of the Invention

The present invention is related generally to a method for dry-cleaning garments or fabrics, and, more particularly, to such method using gas jets to provide agitation that removes insoluble/particulate soils and prevents the re-deposition of such soils.

2. Description of Related Art

A typical dry-cleaning process consists of a wash, rinse, and drying cycle with solvent recovery. The garments are loaded into the cleaning drum and immersed in cleaning fluid pumped into the drum from a base tank. The soluble soils associated with the garment fabrics dissolve in the cleaning fluid and hence are readily removed. However, insoluble soils must be physically dislodged from the fabrics by agitation. Accordingly, the drum tumbles the garments during the and rinse cycles to provide the necessary agitation to remove insoluble soil by physical dislodgment.

Sufficient care must be exercised to prevent the re-deposition of insoluble soil (also termed "particulate soil") on the garments once it is initially removed. Generally, once a soil has re-deposited onto a garment, it cannot be removed by subsequent agitation. Accordingly, high solvent flow rates (on the order of one gallon per minute per pound of garments) are generated to transport solvent-containing particulate soil out of the cleaning chamber and through a battery of filters before soil re-deposition occurs. At regular intervals, the cleaning fluid must undergo a distillation step to remove the dissolved soils and dyes. The stills are either part of the dry-cleaning machine itself, or self-standing.

The dry-cleaning industry has employed such solvents as perchloroethylene (PCE), petroleum-based or Stoddard solvents, CFC-113, and 1,1,1-trichloroethane, all of which are generally aided by a detergent. However, U.S. Pat. No. 5,467,492 having the same assignee as the present application entitled "Dry-Cleaning of Garments Using Liquid Carbon Dioxide Under Agitation as Cleaning Medium") discloses an apparatus and method for employing liquid carbon dioxide as the cleaning medium in dry-clang operations. The contents of that patent, hereinafter referred to as the "Liquid Carbon Dioxide" application for brevity, are incorporated herein as a reference.

Regardless of the type of solvent used, agitation of garments in the cleaning medium is performed to accelerate removal of soluble soils and is essential in the removal of particulate (insoluble) soils. When conventional dry cleaning solvents are used, agitation is generally supplied by a rotating drum as described above. When liquid carbon dioxide is used, agitation may be provided by several means, such as gas bubble/boiling processes, liquid agitation, sonic agitation, and liquid agitation by stirring. Each of these agitation processes are described in the above-mentioned related "Liquid Carbon Dioxide" application. In short, the gas bubble/boiling processes induce agitation by boiling the cleaning solution so that gas bubbles are produced which, in turn, initiate the garment agitation and tumbling necessary for particulate soil dislodging. Liquid agitation involves providing liquid solvent inflow through one or more nozzles arranged in such a configuration as to promote the tumbling action through agitation of the cleaning medium and thus the garments contained therewithin. Sonic agitation involves agitating the garments and fabrics with pressure waves and cavitation using sonic nozzles strategically placed around the internal perforated garment basket. Finally, liquid agitation may be provided by simply stirring the cleaning solvent with the use of, for instance, an impeller located under the mesh garment basket. It is also known to use various agitation methods simultaneously to achieve greater agitation.

It follows that, given the various types of equipment and chemicals employed in the dry-cleaning trade, it is relatively expensive to set up and operate a dry-cleaning establishment. The initial capital investment includes the purchase of a costly cleaning chamber with an agitation means as well as expensive pumps and large diameter plumbing, which is required to generate the high solvent flow rates used to prevent particulate soil re-deposition Operating expenses include high electricity costs to drive pumps generating high solvent flow rates, as well as the cost of cleaning solvents.

While the expense of cleaning solvents is reduced with the use of such dense phase gases as liquid carbon dioxide as opposed to conventional cleaning solvents, the initial capital equipment costs are even more pronounced in dry-cleaning processes utilizing dense phase gases. The higher costs stem from the necessity of operating such systems at high pressure in order to maintain the gases in a liquid state. For example, the operating pressure of a cleaning chamber employing liquid carbon dioxide ranges from about 500 to 1,500 psi (pounds per square inch; 35.2 to 105.4 $Kg/cm^2$) for the purpose of maintaining the carbon dioxide in a liquid state. The cost of high pressure chambers increases linearly with pressure, height, and the square of their radius. Thus, while liquid carbon dioxide costs only a fraction of the cost of conventional dry-cleaning solvents (such as PCE) and is preferred in terms of its environmental soundness, the higher initial capital investment required to implement a liquid carbon dioxide dry-cleaning operation may prohibit a transition from conventional dry-cleaning solvents.

Thus, there is a need for a method of dry-cleaning that provides the agitation necessary for removal of insoluble soils that is more cost-effective than existing equipment.

SUMMARY OF THE INVENTION

In accordance with the present invention, an apparatus and method are provided which remove particulate soils from fabrics by agitation with gas jets. While conventional dry-cleaning processes combine agitation and solvent-immersion steps to simultaneously remove both soluble and insoluble soils, the present gas-jet agitation process is conducted separately from the solvent-immersion process. By removing particulate soils in a solvent-free, non-pressurized environment, considerable savings in equipment and operating costs may be realized. The method of the invention comprises:

(a) placing soiled materials in a walled vessel, the soiled materials comprising garments and fabrics soiled with particulate soils;

(b) introducing into the walled vessel at least one stream of gas, the at least one stream of gas issuing from at least one nozzle;

(c) contacting the soiled materials with the at least one stream of gas, thereby agitating the soiled materials, whereupon the at least one stream of gas collectively forms diffused gas; and (d) allowing the diffused gas to exit the walled vessel.

The apparatus of the present invention comprises:

(a) a walled vessel for receiving gas thereinto, the gas entering the walled vessel in at least one stream, the walled vessel having a side wall, an end wall, and a door, with the side wall defining a cylindrical shape;

(b) an inlet means attached to the side wall of the walled vessel, the inlet means comprising at least one nozzle for introducing the at least one stream of gas into the walled vessel;

(c) reservoir means for supplying the gas to the inlet means;

(d) a liner within the walled vessel for containing the soiled garments and fabric materials to be cleaned, the liner selected from the group consisting of a perforated liner and a mesh basket, the liner having a cylindrical shape;

(e) a means for filtering the gas within the walled vessel; and (f) an outlet means in the walled vessel for removing said gas therefrom;

whereby the soiled garments and fabric materials are placed in the liner within the walled vessel and agitated by the at least one stream of gas, whereupon the insoluble materials are dislodged and removed from the soiled garments and fabric materials.

By performing the gas-jet agitation process separately from the solvent-immersion process, solvent operations can be conducted at substantially reduced solvent flow rates. Accordingly, equipment such as pumps and cleaning chambers may be downsized for considerable equipment savings, and energy may be conserved by transporting smaller volumes of solvent. Further, the use of a separate gas-jet agitation process reduces the amount of detergents required for dry cleaning. More specifically, one of the major functions of detergent is to suspend particulate soils in preparation for removal by agitation. The practice of the present invention reduces or obviates the need for detergent to serve as a suspension component. In sum, the gas-jet agitation process of the present invention provides the opportunity for substantial savings in capital and operating costs.

The gas-jet technology of the present invention is applicable to any type of dry cleaning process, regardless of the type of dry-cleaning solvent employed. However, the savings in capital and operating costs prove especially beneficial in dry-cleaning processes using dense phase gases as cleaning solvents. In the high pressure environment required to maintain the liquid phase of dense phase gases, the capital costs of equipment such as cleaning chambers and pumps are notably higher. Given that the practice of the invention allows the particulate soil removal step to be accomplished in a low pressure chamber (usually less than 100 psi, or 7.0 $Kg/cm^2$), expensive high-pressure equipment may be downsized to reflect lower flow rates, thereby achieving a substantial reduction in capital costs. Finally, in dry-cleaning processes taking advantage of the natural refrigerative properties of dense phase gases to cool equipment, the need to vent such dense phase gases for cooling purposes is decreased given the lower process heating effects resulting from decreased flow rates and agitation.

Importantly, reducing the capital costs necessary to implement a dense phase gas dry-cleaning system will make such solvents more competitive in comparison to conventional dry-cleaning systems employing such solvents as PCE, thereby accelerating the transition to environmentally-preferred dense phase gas systems.

The ability of the present gas-jet agitation system to remove particulate soils from garments and fabrics rivals that of conventional dry-cleaning processes which agitate the garments and fabrics while immersed in solvent. Advantageously, the simple design of the apparatus employed in the practice of the invention has no moving parts and is relatively inexpensive to fabricate and maintain. Further, the gas used as a means of agitation may be any commonly-available inexpensive gas, such as carbon dioxide, nitrogen, or air, so that the process is environmentally-friendly. Thus, the method of the present invention allows the realization of substantial savings in capital and operating costs in exchange for a relatively modest investment.

DESCRIPTION OF THE PREFERRED EMBODIMENTS

The agitation and solvent-immersion steps of a conventional dry-cleaning process can be separated for substantial savings in capital costs and operating expenses. Gas-jet agitation may be performed to remove particulate soils from garments and fabrics, while solvent immersion with minimal agitation may be conducted to remove soluble soils in a separate process. By separating these two basic dry cleaning steps, the capital costs and operating expenses necessary to conduct the solvent-immersion step may be substantially reduced. The savings possibilities are particularly pronounced for dry-cleaning processes such as dense phase gas systems, which employ high pressure equipment.

To dry clean garments and fabrics soiled with both particulate soils and soluble soils, both agitation and solvent-immersion steps are necessary. Generally, both types of soils are present in soiled garments. While gas-jet agitation is very effective in removing particulate soils (as illustrated by the Examples below), solvent-immersion is required to remove soluble soils such as body oils. Thus, while it is conceivable that the dry-cleaning process may consist only of gas-jet agitation, it is more likely that solvent-immersion will be required as well.

The gas-jet agitation process may be conducted either before or alter a solvent-immersion step. For garments containing a minimal amount of soluble soils, it is advantageous to perform the gas-jet agitation first. Redeposition of particulate soils is minimized under these conditions. In contrast, for garments containing large amounts of soluble soils, it is advantageous to conduct solvent immersion first, since soluble soils can actually bind particulate soils to fabrics. The removal of soluble soils by immersion in dry cleaning solvents may effectively prepare the particulate soil to be released from the fabric by gas-jet agitation.

Figure 1A:
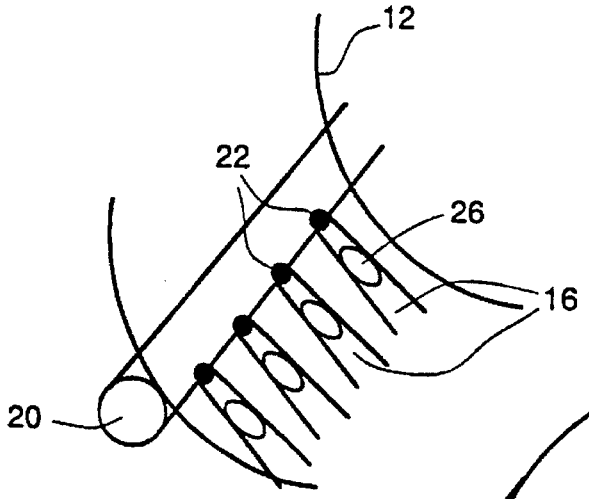
FIG. 1A is an enlarged cut-away view of the nozzle configuration of the gas-jet cleaning apparatus of FIG. 1, illustrating the proper orientation of the nozzles in the practice of the invention.
Figure 1:
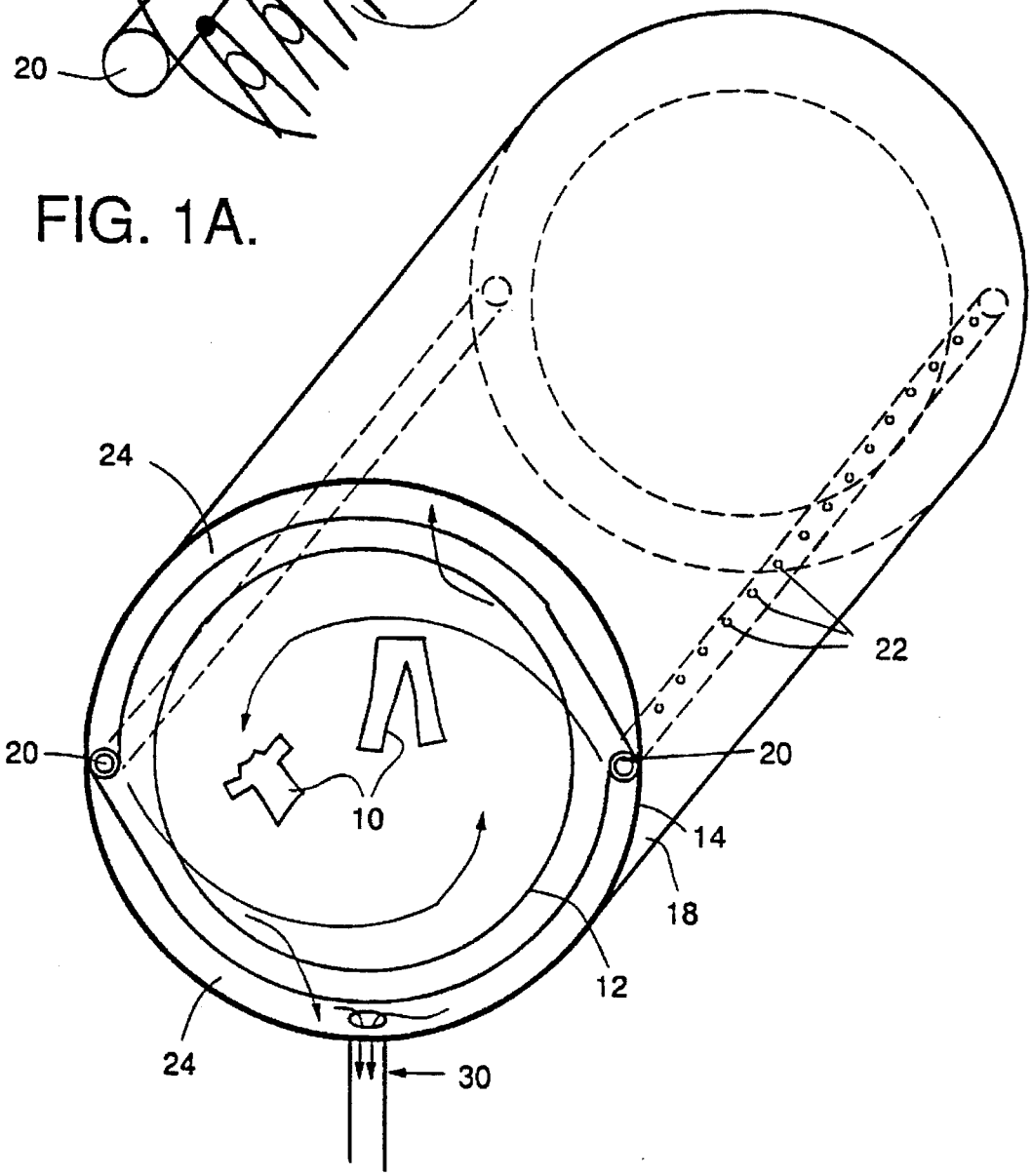
FIG. 1 is a cut-away perspective view illustrating a gas-jet cleaning apparatus constructed in accordance with the present invention and suitable for commercial use.

Turning now to the drawings, wherein like reference numerals designate like elements, an apparatus representing a preferred embodiment of the gas-jet cleaning chamber of the present invention is portrayed in FIG. 1. The fabrics and garments 10 to be cleaned are loaded into a liner 12 within the cleaning chamber 14. The cleaning chamber 14 is constructed of a solid side wall 16 and a solid end wall 18, such that with the addition of a door (cut away), it completely encloses the liner 12 and garments 10 during processing. The liner 12 serves to contain the garments as well as to allow the transmittal of gas 20 for purposes of inducing agitation of the garments and transporting soil away from the garments. As such, the liner 12 must have sufficient structure to contain the garments balanced with sufficient holes to allow the transmittal of gas 20. The liner 12 may be in the form of a perforated drum, but, to simplify maintenance procedures, it is preferably a removable inner basket made of screen mesh. To encourage an effective garment circulation pattern during agitation (as discussed more fully below), the shape of the liner should be such as to promote a continuous tumbling action of the garments 10 into the vortex of the flowing gas stream 20. Accordingly, the liner 12 is preferably constructed in a cylindrical shape. Between the liner 12 and the solid walls 18 of the chamber are gas filtering means 22 designed to remove insoluble particulates from the gas stream 20. The filtration means 22 may comprise equipment such as, but not limited to, electrostatic precipitators or paper filters. Although not shown in FIG. 1, the door of the cleaning chamber 14 should likewise be equipped with filtration means.

A gas inlet (or inlets) 24 is provided at the side wall 16 of the cleaning chamber 14. The gas inlet 24 is connected to at least one nozzle 26. As shown in greater detail in FIG. 1A, the nozzle 26 should be oriented such that the gas stream 20 is tangent, or slightly inward of tangent relative to the liner 12, and hence sets up a vortex motion within the liner 12. Preferably, a manifold of nozzles 26 is provided for more effective agitation of the garments 10. When multiple nozzles 26 are used most of the nozzles should be aligned to contribute to the vortex motion of the gas 20.

The liner 12 must have a set of holes that are aligned with the manifold nozzles 26, such that the flow of incoming gas 20 is unimpeded by the liner 12. These holes 28 may be comprised of perforations in the liner 12 as described above, or may be additional holes specifically located to match the nozzle arrangement.

Referring once again to FIG. 1, it is preferable that the manifold of nozzles 26 be centered along the side wall 16 of the cleaning chamber 14 and span the entire length of the liner 12. The manifold of nozzles 26 is connected via the gas inlet 20 to a gas supply reservoir 40. Lastly, a gas outlet 30 is provided in the cleaning chamber 14, preferably at the bottom. As in any process involving the transport and handling of fluids, it is important to properly size and tailor components such as nozzles, pumps, pipes, and chambers (such as the cleaning chamber 14) to the specific application at hand. With proper design, optimum fluid flow rates, reduced cycle times, and ultimately, optimum performance may be realized.

In the operation of the gas-jet cleaning chamber 14, the fabrics and garments 10 to be cleaned are loaded into the liner 12, whereupon the cleaning chamber is completely enclosed by the placement of a door (not shown). A gas is transported into the chamber from the gas supply 40 through the gas inlet 24 and into the manifold of nozzles 26, thereby forming a high speed jet stream. The high-speed gas sets up convective vortex currents in the enclosed cleaning chamber, as illustrated in FIG. 1. As the gas exits the nozzle(s) 26, its speed entrains the fabrics 10 within its vicinity. The fabric experiences a momentary acceleration relative to its trailing end as it is moved into the fluid stream 20, resulting in a "stretch". The fabric 10 relaxes upon reaching the apex of the vortex, whereupon the fabric slides down the wall of the liner 12 into the incoming gas stream 20 to undergo another "stretch and relax" cycle. The repeated "stretch and relax" cycles undergone by the garments provide the continuous agitation necessary to mechanically expel particulate soils from the garments. Once expelled, the particulate soils are transported by the gas stream 20 out of the liner 12 and are removed from the gas stream 20 by the filtration means 22 within the cleaning chamber 14. Thus, it has been illustrated how the gas stream creates a continuous tumbling action to agitate the garments 10. The filtered gas exits the cleaning chamber 14 via the gas outlet 30.

The gas used in the gas-jet agitation cleaning process is preferably selected from a group of inexpensive, common non-toxic, non-flammable gases, although any gas would likely be effectual. Examples of such gases include, but are not limited to, air, nitrogen, and carbon dioxide. The phase of the gas employed may be either "dry" (uncompressed) or "dense phase" (compressed to the point of liquification). With an appropriate choice of gas for use in the practice of the invention, the present process can be conducted without the expensive environmental controls necessary when toxic chemicals such as PCE are employed. Only the particulate soil removed from garments 10 by the process of the invention need generate any environmental concern, and one could speculate that soiling substances removed from garments should pose a negligible environmental threat.

When compressed liquified carbon dioxide is used as the source of the gas jet, fluid enters the gas inlet 24 as liquid. A phase change takes place instantaneously at the nozzles 26. A portion of the liquid boils into gas, leaving the remaining liquid at a lower temperature. During short exposure times, all the carbon dioxide vaporizes into gas, and hence the action is equivalent to jets of nitrogen. During longer exposure times, however, more substantial temperature drops will occur. If the pressure in the cleaning chamber 14 is also allowed to rise, a condition will be generated wherein a portion of the carbon dioxide remains as liquid. Specifically, for a portion of the carbon dioxide to remain in the liquid phase, the pressure must be above the triple point of carbon dioxide (75 psi, or 5.28 $Kg/cm^2$) and the temperature must be equal to the boiling point of carbon dioxide at that pressure. Thus, the carbon dioxide takes the form of a liquid spray which can then contact the liner 12. Retaining at least a portion of the carbon dioxide in liquid form can be beneficial. For example, if the liner 12 is covered with particulate soil, the spraying action can wash off the particulate soil into the filtration means 22, thus eliminating the possibility that the particulate soil can be picked up by the garments as re-deposition soil.

Various surface treatment agents may be added to the gas of choice to enhance the dry cleaning process. For example, finishing agents commonly employed in the dry cleaning industry, such as sizing and anti-static agents, may be added.

Figure 1B:
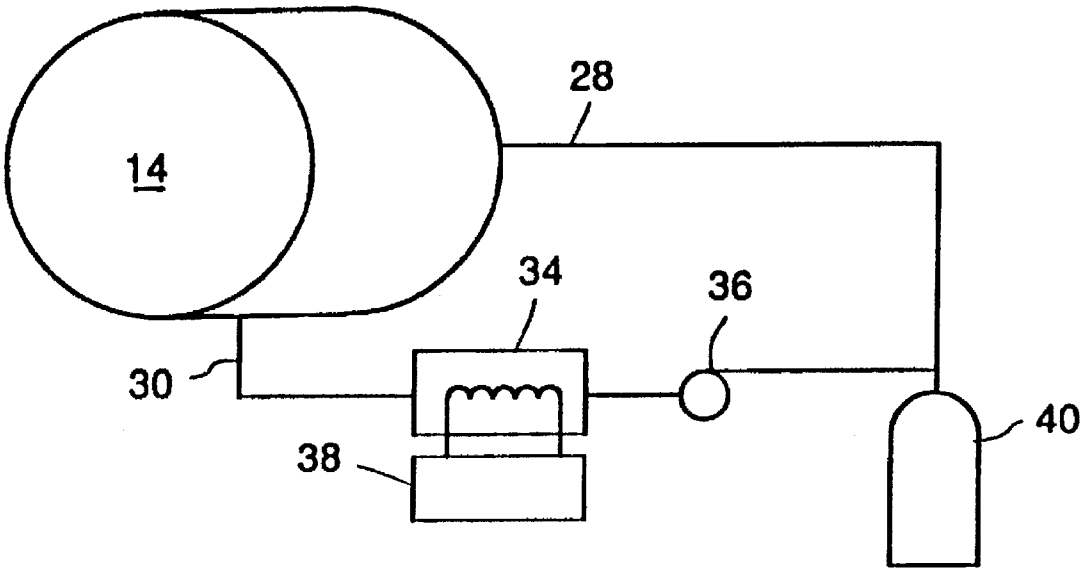
FIG. 1B is a schematic diagram of the supporting apparatus for operating the cleaning chamber of the present invention in a closed loop fashion.
Figure 1C:
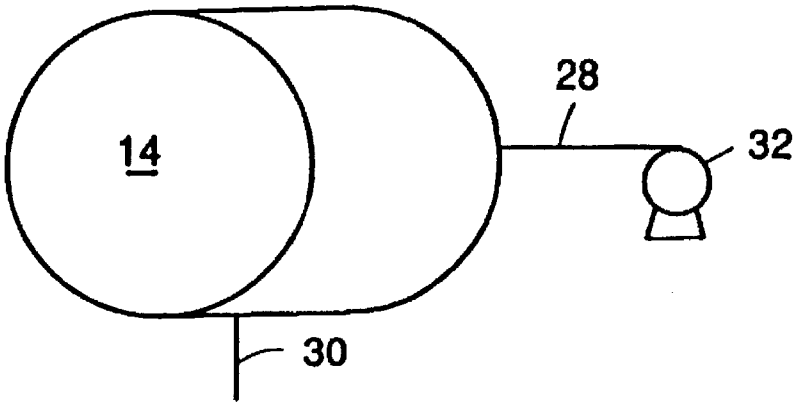
FIG. 1C is a schematic diagram of the supporting apparatus for operating the cleaning chamber of the present invention in an open loop fashion.

The present gas-jet process may be conducted in either an open loop or closed loop fashion. A closed loop manner of operation is preferable if a specific gas such as carbon dioxide or nitrogen is chosen, while an open loop operation is available if air is the gas of choice. Turning now to FIG. 1B, which illustrates a closed-loop mode of operation for a dense phase gas operation, the gas outlet 30 is connected to a condenser 34 to condense the gas to a dense phase state in preparation for return to the gas supply tank 40. A refrigeration unit 38 extracts the heat from the condensation process. The pump 36 serves to transport the dense phase gas from the condenser 34 to the storage tank 40. Dense phase gas returns to the cleaning chamber 14 through inlet line 28. Other apparatus that may be employed in a closed loop process include a valve (not shown) for introducing additives into the dense phase gas before its entry into the cleaning chamber 14. Turning to FIG. 1C, which illustrates an open-loop mode of operation, equipment such as a fan or compressor 32 may be used to transport the gas at the pressure needed to form a high speed convective current. The choice of equipment used to transport the gas to the cleaning chamber 14 does not form part of the invention but should reflect careful consideration of the process operating parameters.

Typical pressures contemplated for the incoming gas 20 described herein range from about 10 to 300 psi (0.7 to 21.1 $Kg/cm^2$), depending on such factors as the amount and weight of the garments 10 to be cleaned and the flow rate of the gas 20. In general, higher pressures will be needed for larger, heavier garments 10 and for loads with a large number of garments 10. The pressure of the incoming gas 20 should be controlled with a pressure regulator, since this pressure will in turn determine the flow rate. Flow rates will accordingly range from 100 liters per minute for a small chamber up to about 10,000 liters per minute for large loads. A pressure regulator is critical when using a dense phase gas from a compressed gas supply 40, since its pressure is usually substantially higher than is necessary for the gas-jet agitation process. Although the cleaning chamber 14 may be operated near atmospheric pressure to simplify its design requirements, the present process is also effective at elevated pressure and may be conducted within the solvent cleaning vessel (not shown), thereby eliminating the labor associated with loading and unloading the vessel.

The process of the invention can be conducted at any temperature that is compatible with the fabric 10 to be cleaned. The upper temperature limit is that at which fabric shrinkage starts to occur. The lower process temperature for moisture-containing garments 10 is 0° C., since formation of ice can trap particulates. In the practice of the invention the temperature is preferably within the range of about 0° to 50° C. While in general the use of ambient temperature gas is adequate, the temperature of the gas 20 entering the cleaning chamber 14 may be regulated by either a heater or a chiller unit (not shown). In one embodiment, gas-jet agitation can be started at a slightly elevated temperature to reduce moisture content of the garments 10, then the temperature can be allowed to drop below 0° C. At the end of the particulate soil cleaning cycle, the gas temperature can again be raised back to ambient temperature to prevent excessive condensation on the garments 10 as they are removed from the chamber 14. Thus, garment moisture regain can be regulated by the gas-jet temperature and initial moisture content of the garments themselves. Further, this approach is useful in reducing the pressure requirement when boiling liquefied gases are used to rinse the walls of the liner 12 during the gas-jet cleaning to prevent re-deposition, as described above.

The optimal duration of the agitation process depends on many factors, such as the extent of soiling of the garments 10, load size, and the gas flow rates employed. However, it is advantageous to minimize the exposure of garments 10 to the agitation generated by high speed gas, which necessarily stresses the fabrics. As illustrated in the Examples below, gas-jet agitation may be effective in as little as 15 seconds, and in any case 5 minutes of agitation is probably sufficient. Most preferably, the duration of agitation ranges from about 1 to 2 minutes. By optimizing the duration of agitation, fabric stress may be reduced and system throughput maximized.

As with solvent-based dry cleaning, it is necessary to prevent the re-deposition onto garments 10 of particulate soils already dislodged by gas-jet agitation. In the absence of a solvent, various strategies are available to avoid re-deposition of particulate soils. These include employing ionized incoming gas to eliminate static charge as well as the use of electrostatic precipitators as a filtering means 22 for the outgoing gas. Further, re-deposition is avoided by the use of the liner 12 within the cleaning chamber 14. Without the liner 12, significant re-deposition is possible whereby garments contact the soil-coated side wall 16 and end wall 18 of the cleaning chamber during gas-jet agitation. Hence, the minimum "solid wall" surface area of a mesh or perforated liner 12 allows particulate soils entrained in the gas stream 20 to pass through, while the garments 10 are retained for further agitation, thereby protecting the garments from re-deposition.

The following examples are provided to illustrate the various principles of the gas-jet agitation method and apparatus, as well as the effectiveness of gas-jet agitation in removing particulate soils from soiled garments.

EXAMPLES

Figure 2:
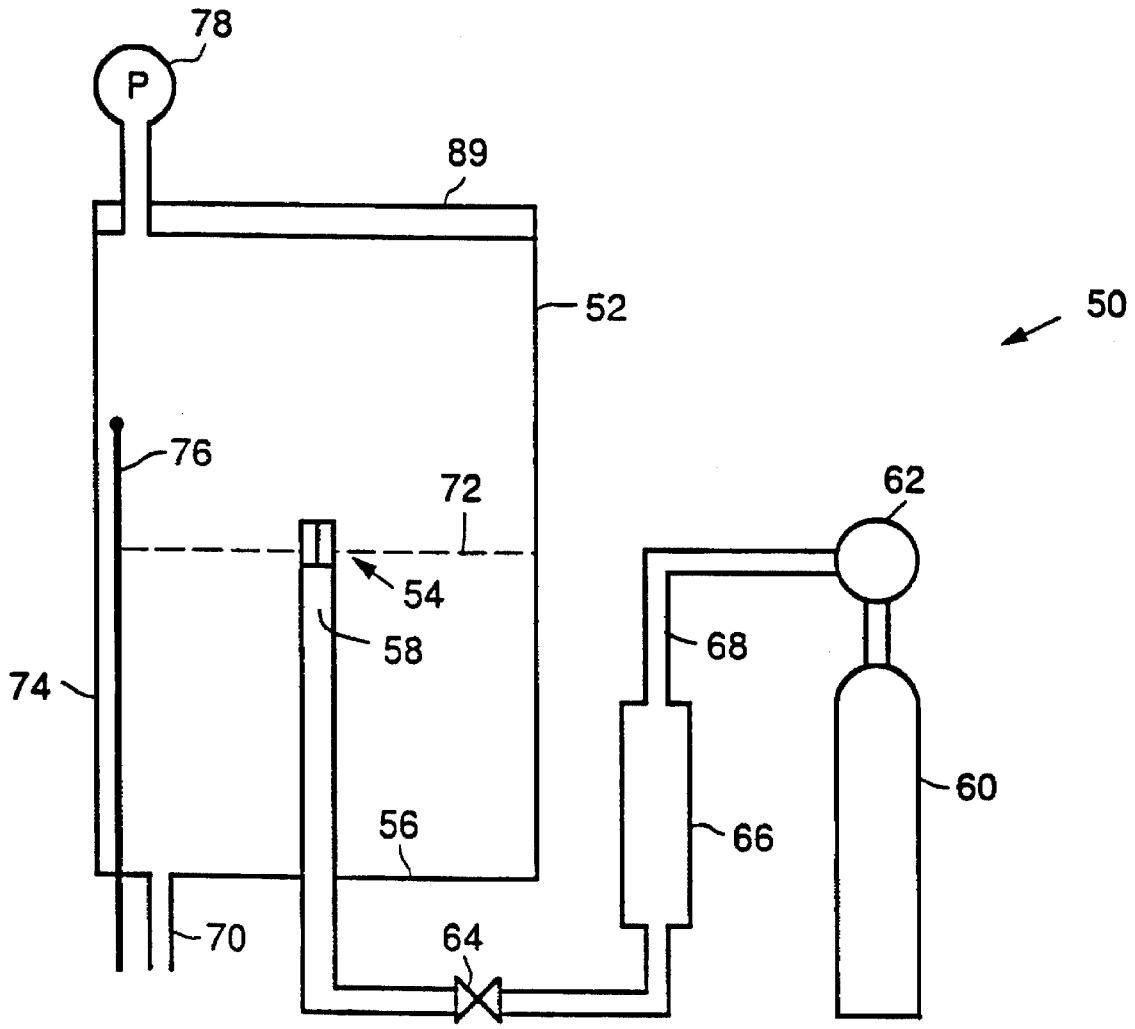
FIG. 2 is a schematic view of the simple gas-jet cleaning apparatus in which the tests of Examples 1–5 were conducted.

Examples 1–5 were conducted according to the method of the invention in a gas-jet cleaning system 50 depicted schematically in FIG. 2. The cleaning chamber 52 was constructed from a cylindrical vessel 7.25 inches (18.4 cm) in diameter and 14 inches (36.6 cm) tall. A nozzle 54, commercially available from Spraying Systems Co. of Wheaton, Ill. as Part No. 12515, was mounted at the center of the cleaning chamber 52 approximately 7 inches (17.8 cm) from the bottom 56 of the cleaning chamber, pointing in an upright direction. The gas inlet 58 to the nozzle 54 was connected to a tank 60 containing compressed nitrogen, with the pressure regulator 62 set to 200 psi (1.38 Mpa; 14.1 $Kg/cm^2$). A ball valve 64 was used to start and stop the gas flow. A heater 66 was provided in the inlet gas line 68 but was not used in these tests. A gas outlet 70 at the bottom 56 of the chamber 52 was also provided. A false bottom 72 made out of screen mesh was placed in the cleaning chamber 52 at a distance of approximately 7 inches (17.8 cm) from the bottom 56 of the cleaning chamber. The false bottom 72 served to keep the fabrics away from the gas outlet 70 and the lower walls 74 of the cleaning chamber 52, as well as to allow the study of re-deposition patterns. A thermocouple 76 and a pressure transducer 78 were installed to monitor temperature and pressure within the cleaning chamber 52. The cleaning chamber 52 was closed during operation with the placement of a lid 89.

Examples 6 and 7 were conducted for comparative purposes and do not represent the practice of the invention. Both of these tests employed the conventional dry cleaning solvent perchloroethylene (PCE). The methods of agitation used in these tests are described below, but neither test used the gas jets of the present invention for agitation.

In each test, rectangular pieces of cotton cloth measuring 2.75 inches by 4 inches (7.5 cm by 10 cm) were used as test fabrics. The samples were soiled with "rug dust" by the International Fabricare Institute (IFI), which customarily supplies such samples as standards used to measure the performance of dry cleaning processes in removing particulate soils. These samples are used routinely by the dry cleaning industry for evaluating the effectiveness of cleaning processes. A hand-held reflectometer was used to characterize the degree of soiling both before and after each test. Higher reflectance values indicate higher degrees of cleanliness.

Results of the seven tests performed in Examples 1–7 are reported in Table 1 below. Upon review of the final reflectance values presented in Table 1, it is clear that gas-jet agitation performs as well in removing particulate soils as the conventional dry-cleaning method of agitating garments immersed in liquid solvent. An analysis of re-deposition processes for the examples follows the recitation of procedures contained in the following examples.

TABLE 1

INITIAL AND FINAL REFLECTANCE VALUES

| Example No. | Time (min.) | Reflectance Initial | Final |
|---|---|---|---|
| 1 | 1 | 2.1 | 2.7 |
| 2A | 1 | 2.1 | <2.6 |
| 2B | 3 | 2.1 | >2.6 |
| 3 | 1 | 2.1 | 2.7 |
| 4 | 0.25 | 2.1 | 2.7 |
| 5 | 1 | 2.1 | 2.7 |
| 6 | 15 | 2.1 | 2.7 |
| 7 | 15 | 2.4 | 2.8 |

EXAMPLE 1

Three test samples were placed on top of the mesh screen 72 and the cleaning chamber 52 was closed. The samples were exposed to a 200 psi (14.1 Kg/cm$^2$) nitrogen gas jet for one minute at a temperature of about 22° C. The gas outlet line 70 remained open throughout the operation of the gas jet, so that "soil-loaded" nitrogen was eluted as the incoming clean nitrogen agitated the fabric test samples. During the operation of the gas jet, the maximum pressure in the cleaning chamber 52 was 80 psi (552 Kpa; 5.6 Kg/cm$^2$), and the temperature remained at approximately 22° C.

After the cleaning chamber 52 was returned to atmospheric pressure by venting through the gas outlet line 70 the test samples were removed and examined for cleanliness both visually and with the reflectometer. Cleanliness results are tabulated in Table 1, above. Re-deposition was evaluated by examining the walls of the chamber both above and below the level of the screen mesh.

EXAMPLES 2A AND 2B

These tests were conducted identically to the procedure used in Example 1, except that (1) twenty-six (26) pieces of test fabric were placed in the chamber 52 instead of three and (2) the time of exposure was varied. The duration of exposure to the nitrogen gas jet was one minute for Example 2A and three minutes for Example 2B.

Examples 2A and 2B were designed to evaluate the effects of chamber loading, fabric stacking, and lengthier exposure time on the final cleanliness achieved in the practice of the invention. The cleanliness results are reported in Table 1, above. Although the total amount of dust was substantially higher with this larger load, the final reflectance was essentially unaffected in comparison to Example 1.

EXAMPLE 3

Three test samples were placed on top of the mesh screen 72 and the cleaning chamber 52 was closed. The samples were exposed to a liquefied carbon dioxide gas jet for one minute at a temperature of about 22° C. The source of the liquefied carbon dioxide was a tank pressurized to 360 psi (2.48 Mpa; 25.3 Kg/cm$^2$), the tank being attached to the inlet gas line 58 The gas outlet line remained open throughout the operation of the gas jet, so that "soil-loaded" liquefied carbon dioxide was eluted as the incoming clean carbon dioxide agitated the fabric test samples. During the operation of the gas jet, the maximum pressure in the cleaning chamber was 190 psi (1.31 Mpa; 13.4 Kg/cm$^2$), while the temperature dropped from 22° C. to about −30° C. Under these conditions, a portion of the carbon dioxide vaporized from liquid to gas, with the portion that remained liquid reaching the walls of the cleaning chamber 52. After the cleaning chamber was returned to atmospheric pressure the test samples were removed and examined for cleanliness as in Example 1. Cleanliness results are tabulated in Table 1, above.

EXAMPLE 4

This test was conducted identically to the procedure used in Example 3, except that the time of exposure was reduced to 0.25 min. During the operation of the gas jet, the maximum pressure in the cleaning chamber 52 was 111 psi (765 Kpa; 7.8 Kg/cm$^2$), while the temperature dropped from 22° C. to about −1.5° C. Under these conditions, essentially all of the carbon dioxide vaporized from liquid to gas. The cleanliness results for this example are reported in Table 1, above, which indicates that decreasing the time of exposure to just 15 seconds does not necessarily adversely affect the ultimate cleanliness reached. Thus, it can be deduced from these examples that most of the cleaning takes place in the first seconds of agitation.

EXAMPLE 5

This test was conducted identically to the procedure used in Example 3, except that twenty-six (26) pieces of test fabric were placed in the chamber instead of three, along with one piece of clean fabric used to evaluate re-deposition onto the fabric. The cleanliness results for this example are reported in Table 1, above. Although the total amount of dust was substantially higher with this larger load, the final reflectance was essentially unaffected.

COMPARATIVE EXAMPLE 6

A test sample was placed in a one liter jar along with 100 ml of perchloroethylene (PCE) and 1% Staticol (dry cleaning detergent). After closing the lid, the sample was vigorously agitated for 15 min. by an up/down shaking motion at a rate of about 60 times per minute. The sample was then removed from the jar and allowed to air dry. The reflectance of the same was then measured, with the results shown in Table 1, above.

COMPARATIVE EXAMPLE 7

A test sample was cleaned by a commercial dry cleaning establishment that utilized PCE, water (4%), and a detergent cleaning medium. This example is included for comparative purposes to dry cleaning processes in which the agitation is conducted on solvent-immersed garments rather than by gas-jet agitation in a solvent-free, low-pressure environment. The cleanliness results for this example are reported in Table 1, above, which indicates that the initial reflectance for this test sample was inflated compared to other examples, but the final reflectance was essentially the same as that achieved in accordance with the practice of the invention.

Analysis of Re-deposition Processes

In each of the Examples 1–5, dust (particulate soil) was visible on the walls of the chamber 52. Generally about 80% of the dust was below the screen mesh. This stems from the fact that the turbulence necessary to keep soil in suspension was much higher above the screen bottom 72 of the cleaning chamber.

In Examples 3 and 5, the dust was concentrated a few inches below the screen mesh 72 and showed a characteristic pattern of having been washed down by the liquid carbon dioxide which had subsequently evaporated upon reaching a warmer portion of the vessel. More specifically, it appeared that about 90% of the dust was below the mesh screen, indicating that the liquid washing technique was effective at reducing the possibility of re-deposition. Furthermore, the clean fabric sample initially added in Example 5 showed only a slight decrease in brightness further confirming minimal re-deposition.

The experimental results of Examples 1–5, in comparison to Examples 6–7, show that gas-jet agitation is as effective in the removal of particulate soils as conventional solvent-immersed agitation. Furthermore, gas jet particulate soil removal is advantageous because (1) it substantially reduces the capital and operating costs of dry cleaning: (2) it is faster than conventional agitation processes; and (3) it can be accomplished in a "dry" state without additives. In fact, solvent immersion can be completely obviated by the practice of the invention for garments having only insoluble soil staining.

INDUSTRIAL APPLICABILITY

The method of agitating soiled garments and fabrics with gas jets to dislodge particulate soils is expected to find use in dry cleaning establishments, and is expected to hasten their transition from conventional toxic dry-cleaning solvents such as PCE to environmentally-friendly solvents such as liquid carbon dioxide.

Thus, there has been disclosed an apparatus and a method for removing particulate soil from fabrics by agitation with gas jets in the absence of immersion in a liquid solvent. It will be readily apparent to those skilled in this art that various changes and modifications of an obvious nature may be made, and all such changes and modifications may be made without departing from the scope of the invention, as defined by the appended claims.

What is claimed is:

1. Apparatus for cleaning soiled garments and fabric materials by removing soiling substances therefrom in the absence of immersion of said soiled garments and fabric materials in a liquid solvent, said soiling substances comprising insoluble materials, said apparatus comprising:

(a) a walled vessel for receiving gas thereinto, said gas entering said walled vessel in multiple streams, said walled vessel having a side wall, an end wall, and a door, with the side wall defining a cylindrical shape;

(b) a liner within said walled vessel for containing said soiled garments and fabric materials to be cleaned, said liner selected from the group consisting of a perforated liner and a mesh basket, said liner having a cylindrical shape and a length;

(c) an inlet means attached to said side wall of said walled vessel, said inlet means comprising a manifold of nozzles for introducing said multiple streams of gas into said walled vessel wherein said manifold of nozzles extends said length of said liner and said nozzles are oriented such that said multiple streams of gas are tangent relative to said liner whereby said multiple streams of gas produce a vortex motion within said liner and said vortex motion of said gas directly agitates said soiled garments and fabric materials to remove said insoluble material from said soiled garments and fabric materials;

(d) reservoir means for supplying said gas to said inlet means;

(e) means for removing said insoluble materials from said gas, located within said walled vessel and outside said liner; and (f) outlet means in said walled vessel for removing said gas therefrom, whereby said soiled garments and fabric materials are placed in said liner within said walled vessel and are directly agitated by said multiple streams of gas, whereupon said insoluble materials are dislodged and removed from said soiled garments and fabric materials.

2. The apparatus of claim 1 wherein said gas is selected from the group comprising carbon dioxide, nitrogen, and air.

3. The apparatus of claim 2 wherein said gas comprises compressed gas having a pressure of within the range of about 10 to 300 psi (0.7 to 21.1 $Kg/cm^2$).

4. The apparatus of claim 3 wherein said compressed gas is liquified carbon dioxide.

5. The apparatus of claim 2 wherein said gas further includes at least one surface treatment agent selected from the group consisting of anti-static agents and sizing agents.

6. The apparatus of claim 1 wherein said manifold of nozzles includes flow rate adjusting means such that said multiple streams of gas issue from said manifold of nozzles at a flow rate of within the range of about 100 to 10,000 liters per minute.

7. The apparatus of claim 1 wherein said means for removing said insoluble materials from said gas within said walled vessel comprises at least one of filtration and electrostatic precipitation.

8. The apparatus of claim 1 further including compression means for recompressing said removed gas and means for returning recompressed gas to said walled vessel in the form of at least one stream of gas.

9. The apparatus of claim 8 wherein said recompressed gas is carbon dioxide, said carbon dioxide being liquified as a result of said recompression.

* * * * *

UNITED STATES PATENT AND TRADEMARK OFFICE

CERTIFICATE OF CORRECTION

PATENT NO. : 5,651,276

DATED : July 29, 1997

INVENTOR(S) : Edna M. Purer

It is certified that error appears in the above-identified patent and that said Letters Patent is hereby corrected as shown below:

Title page and on Sheet 1 of 3, in Fig. 1, please delete "24" in both instances and insert therefor --22--;

Title page and on Sheet 1 of 3 in Fig. 1, please delete "22" and insert therefor --26--;

Title page and on Sheet 1 of 3 in Fig. 1, please delete "20" in both instances and insert therefor --24--;

Title page and on Sheet 1 of 3 in Fig. 1, please delete "18" and insert therefor --16--;

In the Drawing:

UNITED STATES PATENT AND TRADEMARK OFFICE

CERTIFICATE OF CORRECTION

PATENT NO. : 5,651,276

DATED : July 29, 1997

INVENTOR(S) : Edna M. Purer

It is certified that error appears in the above-identified patent and that said Letters Patent is hereby corrected as shown below:

On Sheet 1 of 3 in Fig. 1A, please delete "22" and insert therefor "26";
On Sheet 1 of 3 in Fig. 1A, please delete "26" and insert therefor "28";
On Sheet 1 of 3 in Fig. 1A, please delete "20" and insert therefor "24";
On Sheet 1 of 3 in Fig. 1A, please delete "16" and insert therefor "20";
On Sheet 2 of 3, in Fig. 1B, please delete "28" and insert therefor --24--;
On Sheet 2 of 3, in Fig. 1B, please delete "30" and insert therefor --32--;
On Sheet 2 of 3, in Fig. 1C, please delete "28" and insert therefor --24--;
On Sheet 2 of 3, in Fig. 1C please delete "30" and insert therefor --32--.

Signed and Sealed this

Twenty-ninth Day of February, 2000

*Attest:*

Q. TODD DICKINSON

*Attesting Officer*

*Commissioner of Patents and Trademarks*